US009375920B2

(12) United States Patent
Akama et al.

(10) Patent No.: US 9,375,920 B2
(45) Date of Patent: Jun. 28, 2016

(54) LIQUID EJECTION HEAD

(71) Applicant: CANON KABUSHIKI KAISHA, Tokyo (JP)

(72) Inventors: Yuichiro Akama, Tokyo (JP); Kiyomitsu Kudo, Machida (JP); Satoshi Kimura, Kawasaki (JP); Yosuke Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,240

(22) Filed: May 26, 2015

(65) Prior Publication Data

US 2015/0343773 A1 Dec. 3, 2015

(30) Foreign Application Priority Data

May 30, 2014 (JP) ..... 2014-112725
Apr. 6, 2015 (JP) ..... 2015-078012

(51) Int. Cl.
*B41J 2/14* (2006.01)
*B41J 2/05* (2006.01)
*B41J 2/175* (2006.01)

(52) U.S. Cl.
CPC ..... *B41J 2/14072* (2013.01); *B41J 2/1753* (2013.01); *B41J 2002/14491* (2013.01)

(58) Field of Classification Search
CPC .. B41J 2/14072; B41J 2/1753; B41J 2/17553; B41J 2002/14491; B41J 2202/13; B41J 2202/18
USPC ..... 347/50, 57–59
See application file for complete search history.

(56) References Cited

U.S. PATENT DOCUMENTS 7,789,488 B2 * 9/2010 Mori ..... B41J 2/14072 347/50
7,810,907 B2 * 10/2010 Kubo ..... B41J 2/14072 347/50
8,733,907 B2 * 5/2014 Saito ..... B41J 2/1429 347/50

FOREIGN PATENT DOCUMENTS

JP 10-230611 A 9/1998

* cited by examiner

*Primary Examiner* — An Do
(74) *Attorney, Agent, or Firm* — Fitzpatrick, Cella, Harper & Scinto

(57) ABSTRACT

Provided is a liquid ejection head that makes it possible to achieve both of the stability of bonding and the shortening of a bonding time when bonding an electrical wiring substrate where thick leads applied with large current and thin leads applied with small current are mixed and a printing element substrate. For this purpose, the electrical wiring substrate includes wiring lines having different widths, and each of the wiring lines of the electric wiring substrate and a connecting terminal of the printing element substrate are connected by inner leads whose number corresponds to width of the wiring line.

19 Claims, 5 Drawing Sheets

LIQUID EJECTION HEAD

BACKGROUND OF THE INVENTION

1. Field of the Invention

The present invention relates to a liquid ejection head mounted in a liquid ejection apparatus adapted to eject liquid.

2. Description of the Related Art

At present, on a printing element substrate mounted in a liquid ejection head, multiple connecting terminals for connecting to an electric wiring substrate of the liquid ejection head are provided. The connecting terminals provided on the printing element substrate have connecting members made of Au, and the electric wiring substrate has inner leads for corresponding connecting terminals, respectively. The wiring substrate and the printing element substrate are connected to each other through the connecting members and the inner leads. The electric wiring substrate has outer leads on the side opposite to the inner leads, which are connected to an electric wiring member including connecting terminals for connecting to a liquid ejection apparatus.

To connect the connecting terminals of the printing element substrate to corresponding inner leads, a single point bonding method is available. When performing single point bonding, an inner lead and a corresponding connecting terminal are applied with an ultrasonic wave and a load using a tool. To make it possible to stably connect the multiple inner leads, conditions should be established.

Japanese Patent Laid-Open No. H10-230611(1998) describes an example of single point bonding of one inner lead to one connecting terminal. To make it possible to perform the bonding under the same conditions, all inner leads are formed so as to have the same line width.

Recently, in a liquid ejection apparatus, a printing element substrate is increased in length to improve printing speed. Also, in order to efficiently drive energy generating elements for ejecting liquid, voltage is increased for the driving. The increases in length and voltage increase current that flows through a liquid ejection head to drive the energy generating elements.

As described, in the situation where the current flowing through the liquid ejection head is increased, increasing a current amount without changing a line width of an electric wiring substrate may increase a heat generation amount of the electric wiring substrate to impair reliability. A possible method to overcome such impairment is to increase the line width correspondingly to the increased current amount to suppress the heat generation. In such a case, it is necessary to increase the width of inner leads so as to correspond to the current amount as well.

Among the inner leads, leads for logic applied with small current are not required to have increased width, and therefore configured to have different width from that of leads for energy generating element driving current.

As described, in the case where line width is different between the leads for logic and the leads for energy generating element driving current, the connection (bonding) between the inner leads and wiring lines of an electric wiring substrate under the same conditions fails in stable bonding. To stably perform the bonding, joining conditions such as bonding tool width and load should be changed for each of the lead widths. In addition, bonding targets to be bonded under the same conditions are typically simultaneously bonded, and therefore bonding should be performed for each set of bonding conditions, i.e., bonding should be performed several times. For this reason, an extra tool traveling distance is required, increasing a bonding time.

SUMMARY OF THE INVENTION

Therefore, the present invention provides a liquid ejection head that makes it possible to achieve both of the stability of bonding and the shortening of a bonding time when bonding an electric wiring substrate where thick leads applied with large current and thin leads applied with small current are mixed and a printing element substrate.

For this purpose, the liquid ejection head of the present invention includes: a printing element substrate that includes multiple connecting terminals; and an electric wiring substrate that includes a first wiring line having first line width, a second wiring line having second line width, and inner leads that separately connect the first wiring line to a connecting terminal and the second wiring line to a connecting terminal, in which the first wiring line is provided with one of the inner leads, the second wiring line is provided with multiple inner leads, and the second line width is larger than the first line width.

The liquid ejection head of the present invention makes it possible to achieve both of the stability of bonding between an electric wiring substrate where thick leads applied with large current and thin leads applied with small current are mixed and a printing element substrate, and the shortening of a bonding time.

Further features of the present invention will become apparent from the following description of exemplary embodiments (with reference to the attached drawings).

DESCRIPTION OF THE EMBODIMENTS

Embodiments of the present invention will hereinafter be described with reference to the drawings.

First Embodiment

Figure 1:
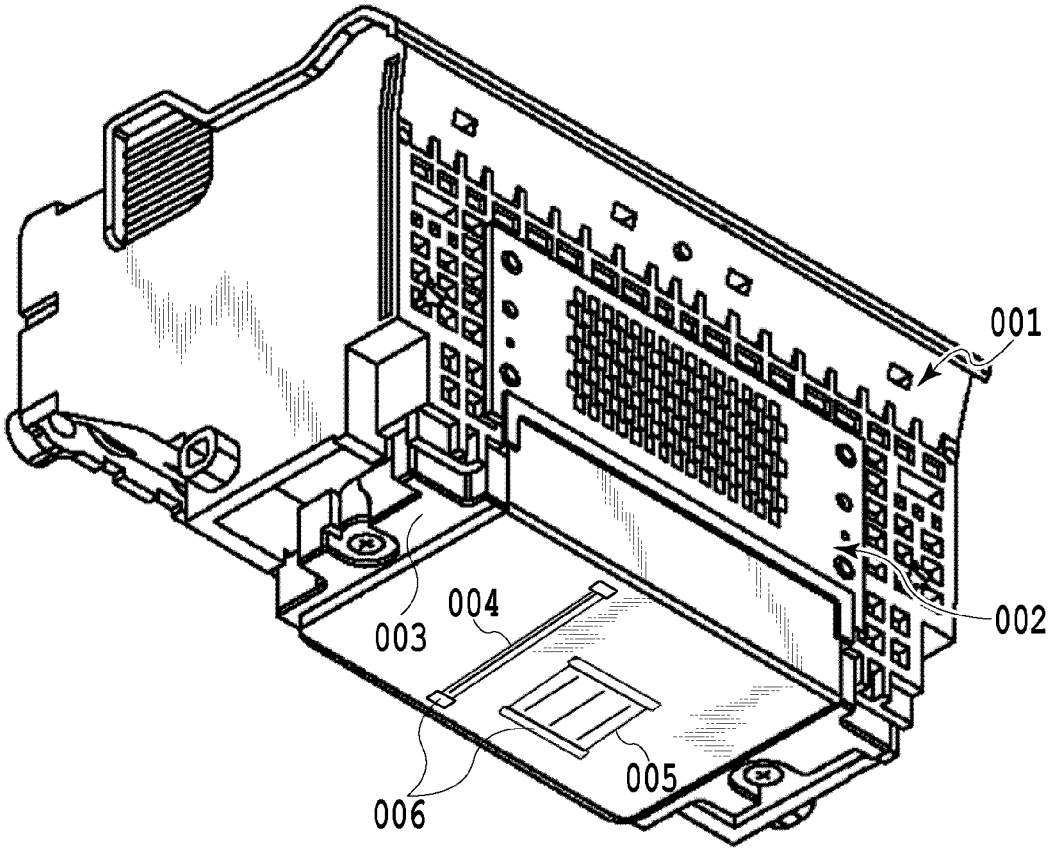
FIG. 1 is a perspective view illustrating a liquid print head of the present invention.

FIG. 1 is a perspective view illustrating a liquid ejection head of the present invention. The liquid ejection head 001 includes printing element substrates A and B 004 and 005 for ejecting liquid. Each of the printing element substrates A and B 004 and 005 includes multiple fine ejection ports for ejecting ink and unillustrated energy generating elements corresponding to the ejection ports.

From the printing element substrate A 004, black ink for printing a monochrome image is ejected. From the printing element substrate B 005, cyan ink, magenta ink, and yellow ink for printing a color image are ejected. The printing element substrates are connected to an electric wiring substrate 003. The connecting parts between the printing element substrates and the electric wiring substrates 003 are sealed by sealant 006.

The electric wiring substrate 003 is bent at an end part of a surface on which the printing element substrates are mounted, and connected to an electric wiring member 002. The electric wiring member 002 includes contact pads for electrically connecting to an unillustrated liquid ejection apparatus, and when mounting the liquid ejection head 001 in the liquid ejection apparatus, electric power is supplied from the liquid ejection apparatus through the contact pads.

The printing element substrate A 004 is 0.8 inches long, and includes 1024 ejection ports on both sides at a resolution of 1200 dpi in a staggered manner across an unillustrated common ink supply port, i.e., 512 ejection ports on one side at a resolution of 600 dpi. The printing element substrate B 005 has ink supply ports for respective colors of cyan, magenta, and yellow, and includes 384 ejection ports on both sides at a resolution of 1200 dpi for each of the colors, i.e., 192 ejection ports on one side at a resolution of 600 dpi for each of the colors.

A drive voltage for each of the energy generating elements is 24 V. Ejection ports are selected depending on a print image, and by heating corresponding energy generating elements, inks can be ejected to perform printing. In the case where a number of ejection ports are simultaneously selected, large current flows through the liquid ejection head 001.

Figure 2A:
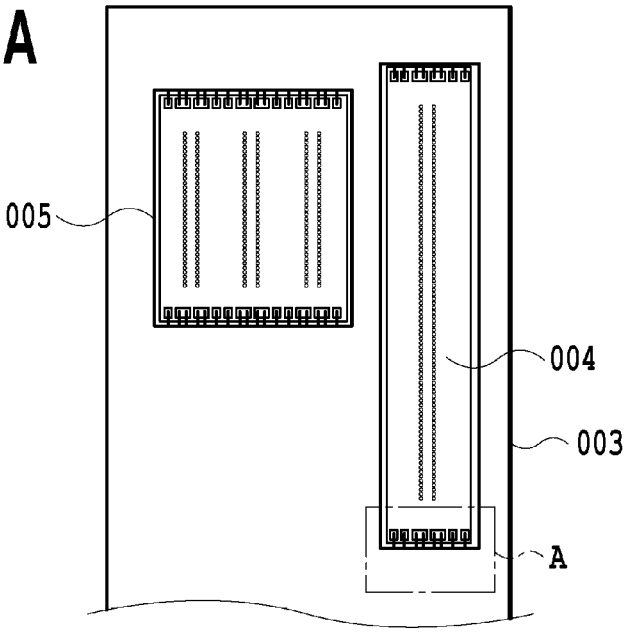
FIG. 2A is a view illustrating printing element substrates connected to an electric wiring substrate.
Figure 2B:
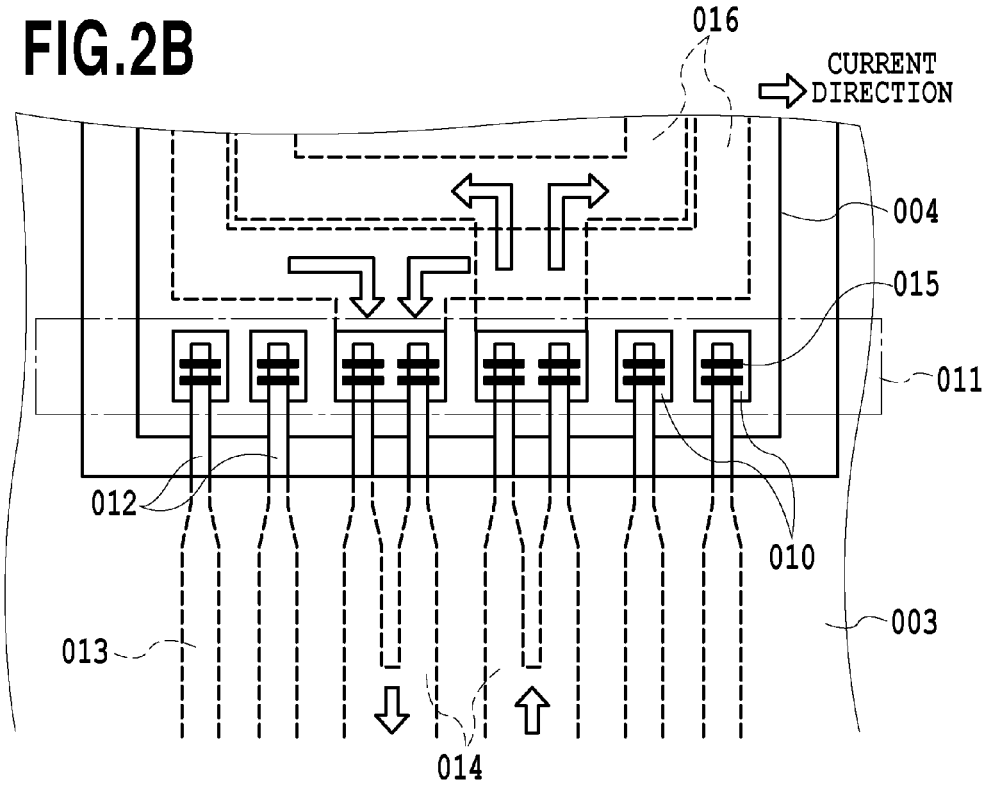
FIG. 2B is a view illustrating one of the printing element substrates connected to the electrical wiring substrate.

FIGS. 2A and 2B are views illustrating the printing element substrates connected to the electric wiring substrate in the present embodiment. FIG. 2A is a view illustrating a first embodiment, in which the connecting states between the electric wiring substrate 003 and the printing element substrates A and B 004 and 005 are illustrated. To facilitate easy understanding of the connecting states, the illustration is given with the sealant removed. The electric wiring substrate 003 and the printing element substrate A 004 or the printing element substrate B 005 are connected to each other by inner leads 012 in an end part (an end part on both sides) of the printing element substrate. The electric wiring substrate 003 is made of a flexible member, and configured to sandwich wiring lines 013 and 014 with a film member made of resin. In the electric wiring substrate 003, two opening parts for exposing the printing element substrates A and B 004 and 005 are formed, and one end parts of the wiring lines extend inward of the opening parts from the edges of the respective opening parts as inner leads. That is, the one end parts of the wiring lines exposed from the edges of the opening parts function as the inner leads.

Here, the printing element substrate A 004 is particularly taken as an example to give a description. FIG. 2B is an enlarged view of the connecting part at one end of the printing element substrate A 004. The connecting part at the other end of the printing element substrate A 004 is in a connecting state symmetrical to that in FIG. 2B with respect to the centerline of the printing element substrate in the shorter direction. At the one end of the printing element substrate A 004, a connecting terminal area 011 is provided, where multiple connecting terminals 010 are arrayed. The connecting terminals 010 are ones formed by gold-plating aluminum exposed through openings of the printing element substrate. Inside the printing element substrate, multiple layers for wiring lines made of an aluminum-copper alloy are provided, via which the electric power supplied from connecting terminals are supplied to the respective energy generating elements. Wiring lines inside the printing element substrate are arranged so as to start from the center and return to the center in order to reduce total wiring resistance. The wiring line thicknesses in the both layers are the same.

On the other hand, in the electric wiring substrate 003, copper wiring lines for supplying the electric power to the printing element substrate A 004 are provided. The wiring lines include: wiring lines 013 of a first wiring group having relatively thin line width for applying low current for signals such as an ejection port selection signal, clock signal, and pulse width signal; and wiring lines 014 of a second wiring group for applying large current for driving the energy generating elements and the like. The wiring lines 014 of the second wiring group are arranged in the center of the printing element substrate as a result of minimizing the total distance of the wiring lines to minimize a voltage drop due to the application of the large current. Also, the wiring lines 013 of the first wiring group are narrowed in width near the end part of the electric wiring substrate 003, and exposed from the electric wiring substrate 003 as the inner leads 012 having thin line width.

The surfaces of the inner leads 012 are gold-plated. Each of the wiring lines 014 branches into two near an end part side of the electric wiring substrate 003, and the two branching lines are narrowed and also exposed from the electric wiring substrate 003 as the inner leads 012 having thin line width. A branching part where the wiring line 014 branches is positioned in an area sandwiched by the film member, and the wiring line 014 is exposed from the opening of the film member as the two wiring lines. Among the wiring lines (inner leads) exposed from the opening, inner leads connected to the wiring lines 013 and the two inner leads connected to the wiring line 014 are substantially the same in width. As described, by providing the branching part of the wiring line 014 having relatively wide width under the film member, and making the widths of the respective inner leads exposed from the opening of the film member substantially the same, the strength can be made substantially the same among the respective inner leads. In doing so, bonding between the inner leads and corresponding connecting terminals 010 can be performed without changing bonding conditions between the wiring line 014 and the wiring lines 013. The inner leads 012 extending from the wiring lines 013 of the first wiring group and the inner leads 012 extending from the wiring lines 014 of the second wiring group have the same width.

The case where the large current flows through the liquid ejection head to drive all the energy generating elements is described. The electric wiring substrate 003 has the two wiring lines 014 of the second wiring group. The wiring line on the right side in FIG. 2B is a higher potential side wiring line. The current flows toward the printing element substrate A004 from the right side wiring line. In the printing element substrate, an in-substrate wiring line branches into two. The current flows from the branching in-substrate wiring lines 016 to the respective heating resistance elements, then passes through wiring lines in the printing element substrate on the lower potential side, and flows to the wiring line 014 on the left side in FIG. 2B through a connecting terminal 010. The same amount of current flows through both of the wiring lines 014, and therefore the number of inner leads per wiring line is the same, i.e., two. The large current flows through each of the wiring lines 014, and the current is equally divided into two because of the presence of the two inner leads 012. For this reason, a calorific value per inner lead is sufficiently small, causing no reliability problem.

The connecting terminals 010 and corresponding inner leads 012 are connected to each other using single point bonding. A connecting terminal 010 and a corresponding inner lead 012 are connected to each other by bringing a bonding tool having a two divided shaped fore end into pressure contact with the inner lead 012 on the connecting terminal 010 and applying pressure and ultrasonic waves to cause metallic bonding. Since the fore end is of the two divided shape, a bonding tool mark of the same shape remains. By establishing conditions such as an appropriate load and ultrasonic wave profile, the connecting terminals 010 and corresponding inner leads 012 can be stably connected to each other without bonding disconnection or damage to the printing element substrate.

The number of the inner leads in FIG. 2B is eight. The eight inner leads all have the same width, and therefore the bonding can be performed on all the eight inner leads under the same conditions. Also, since the eight inner leads are all bonded under the same conditions, it is only necessary to perform the bonding sequentially from the left in FIG. 2B. In addition, the bonding can be performed in arrangement order of the connecting terminals, and therefore a traveling distance of the tool can be minimized to shorten a bonding time.

Note that in the present embodiment, the description is given on the basis of the current directions illustrated in the view. However, the current directions through the wiring lines 014 are only required to be opposite to each other, and therefore the wiring line 014 on the left side in the view may be a current entrance to the printing element substrate, whereas the wiring line 014 on the right hand in the view may be a current exit from the printing element substrate.

Also, in the present embodiment, the bonding is performed sequentially from the left in the view. However, it is only necessary that bonding is performed sequentially in one direction, and a traveling distance of the bonding tool is shortest, and therefore the bonding may be performed from the right in the view.

Further, in the present embodiment, the number of inner leads extending from one wiring line 014 is two. However, the width of one wiring line 014 is determined by applied current and a calorific value, and therefore the number of inner leads is determined by the width of the wiring line 014. In the case where a wiring line 014 has wider width, the number of inner leads may be increased to three or more correspondingly.

Still further, in the present embodiment, the multiple wiring layers where the large current flow are provided in the printing element substrate, and have the same thickness; however, one of the wiring layers may be configured to be thin, whereas the other one may be configured to be thick. In such a configuration, in terms of reducing wiring resistance, it is preferable to form wiring lines of the thin wiring layer only in areas of intersection with the other wiring layer, and before and after the intersection, use wiring lines formed in the thick wiring layer via through-holes.

In the present embodiment, the multiple wiring layers where the large current flows are provided in the printing element substrate; however, a single wiring layer configuration capable of reducing man-hours when manufacturing the printing element substrate is expected to lead to cost reduction.

Also, in the present embodiment, as each of the connecting terminals applied with the large current among the connecting terminals 010, a large-sized terminal formed by connecting two terminals is described; however, the present invention is not limited to this, but may be configured to connect individual connecting terminals to the same wiring line in the printing element substrate.

As described, the electric wiring substrate is provided with the wiring lines having different widths, and inner leads whose number corresponds to each of the widths of the wiring lines connect a wiring line of the electric wiring substrate and a corresponding connecting terminal of the printing element substrate to each other. In doing so, the liquid ejection head that makes it possible to achieve both the stability of bonding and the shortening of a bonding time when bonding the electric wiring substrate where the thick leads applied with the large current and the thin leads applied with the small current are mixed and the printing element substrate.

Second Embodiment

A second embodiment of the present invention is described below with reference to drawings. Note that a basic configuration of the present embodiment is the same as that of the first embodiment, and therefore only a characteristic configuration is described below.

In the present embodiment, a configuration in which a wiring layer of a printing element substrate is a single layer is described below.

Figure 3A:
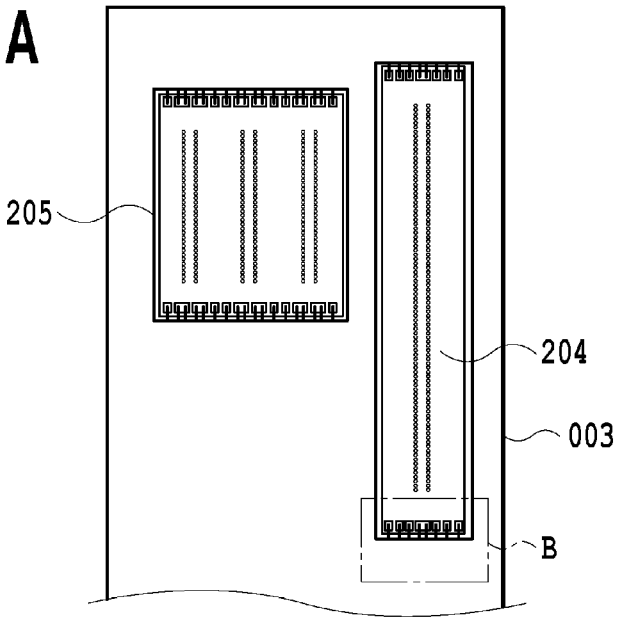
FIG. 3A is a view illustrating printing element substrates connected to an electric wiring substrate.
Figure 3B:
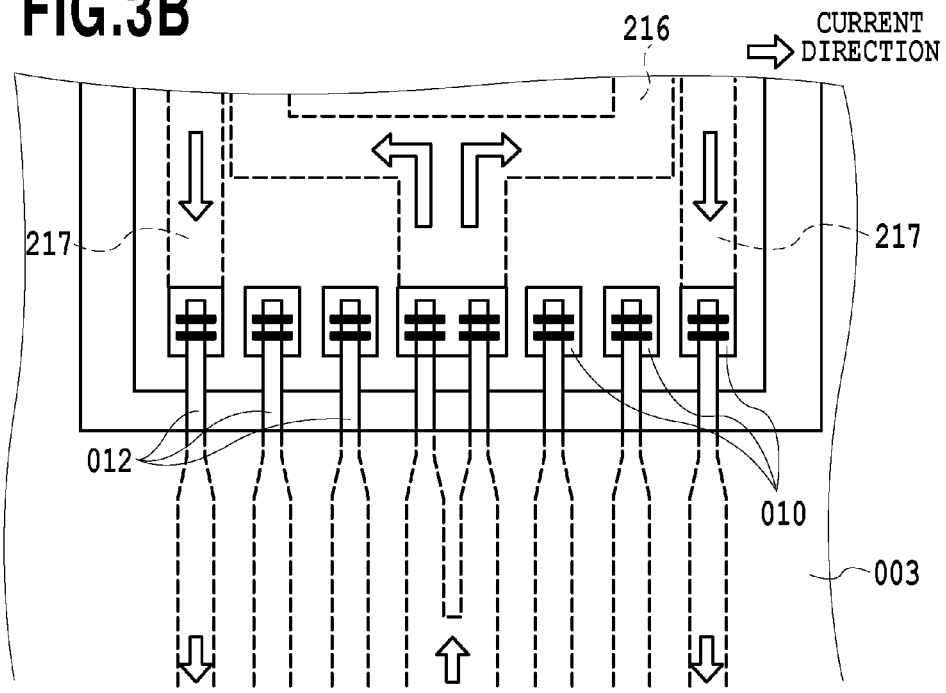
FIG. 3B is a view illustrating one of the printing element substrates connected to the electrical wiring substrate.

FIGS. 3A and 3B are views illustrating printing element substrates connected to an electric wiring substrate in the present embodiment. As in FIGS. 2A and 2B, to facilitate easy understanding of the connecting state, the illustration is given with sealant removed. In the printing element substrate A 204 in FIG. 3A, the wiring layer for current flowing through the printing element substrate is configured as a single layer. For this reason, only the central wiring line 216 that is a wiring line for driving energy generating elements is connected with a wiring line 014 of a second wiring group. As illustrated in FIG. 3B, current flows in through the central wiring line 216, and is divided and flows out from wiring lines 217 on both sides. The wiring line 216 applied with the large current is disposed in the center of the printing element substrate because minimizing the length of the wiring line 216 applied with the large current leads to higher efficiency. In this configuration, since the large current is divided into two in the printing element substrate, the wiring lines 217 on the exit sides are provided on both sides of the printing element substrate, and each of the wiring lines 217 corresponds to only one inner lead of a first wiring group.

As described, in the present embodiment as well, all inner leads have the same width, and therefore can be applied with single point bonding under the same conditions. In addition, the bonding can be performed in arrangement order of connecting terminals under the same conditions, and therefore a traveling distance of a tool can be minimized to shorten a bonding time.

Third Embodiment

A third embodiment of the present invention is described below with reference to drawings. Note that a basic configuration of the present embodiment is the same as that of the first embodiment, and therefore only a characteristic configuration is described below.

The present embodiment is optimally configured for the case where the number of wiring layers is one, and the number of connecting terminals is multiple.

Figure 4A:
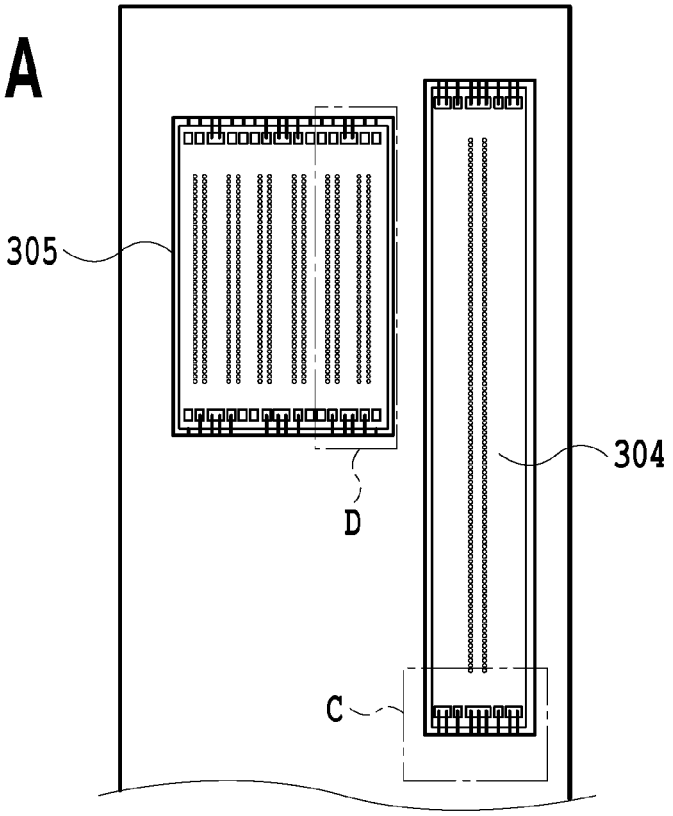
FIG. 4A is a view illustrating printing element substrates connected to an electric wiring substrate.
Figure 4B:
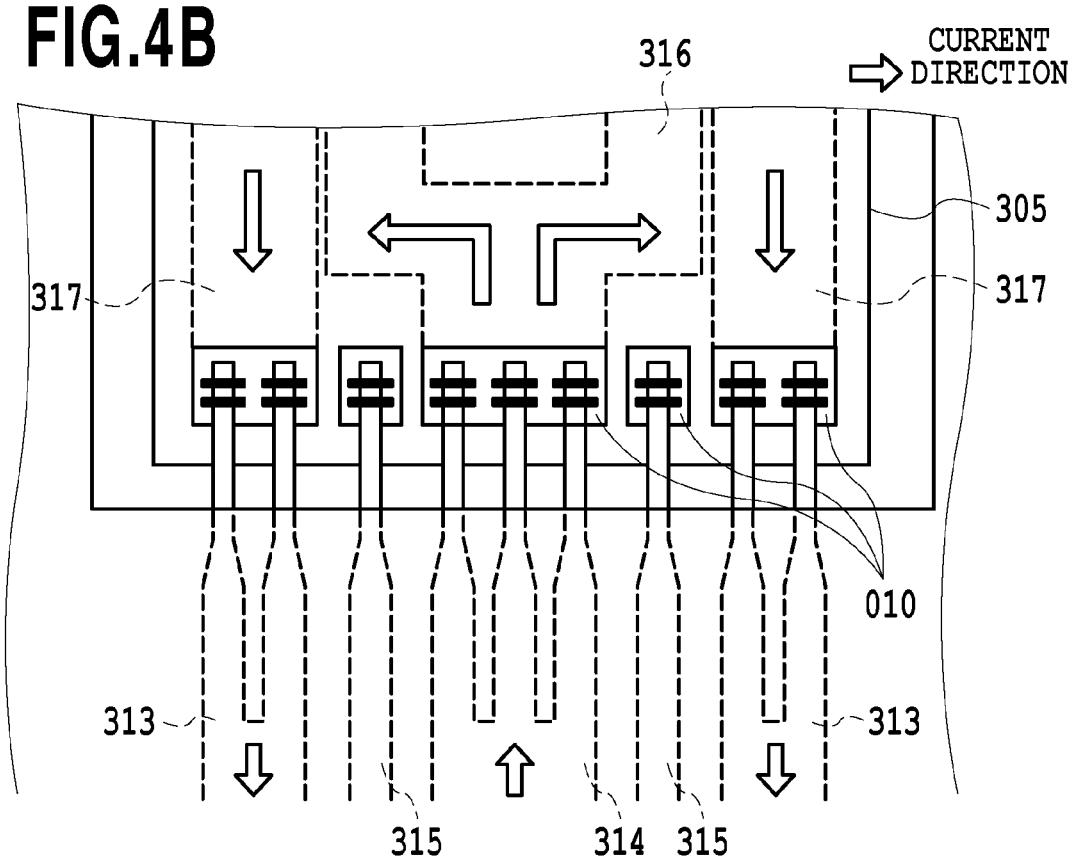
FIG. 4B is a view illustrating one of the printing element substrates connected to the electrical wiring substrate.

FIGS. 4A and 4B are views illustrating printing element substrates connected to an electric wiring substrate in the present embodiment. As in FIGS. 2A and 2B, to facilitate easy understanding of the connecting state, the illustration is given with sealant removed. The printing element substrate A 304 illustrated in FIG. 4A is 1 inch long, and includes 1280 ejection ports on both sides at a resolution of 1200 dpi in a staggered manner across an unillustrated common ink supply port, i.e., 640 ejection ports on one side at a resolution of 600 dpi.

The printing element substrate B 305 has two ink supply ports for each of colors of cyan, magenta, and yellow, and includes 512 ejection ports on both sides at a resolution of 1200 dpi for each of the colors, i.e., 256 ejection ports on one side at a resolution of 600 dpi for each of the colors. This is a redundant configuration having two ejection ports per 1200 dpi. The ink ejection ports are arranged from the left in the color order of cyan, magenta, yellow, yellow, magenta, and cyan. A voltage for driving each of energy generating elements is 32 V.

The connection between the printing element substrate A 304 and the electric wiring substrate 003 is described using FIGS. 4A and 4B. The difference of the present embodiment from other embodiments described above is that current is larger. In the present embodiment as well, a wiring layer having the largest width of a second wiring group is arranged in the center, and has three inner leads corresponding to the line width. The current flows into the printing element substrate A 304 from the central connecting terminal 010, is divided into two in the printing element substrate to flow to the respective energy generating elements, and returns to wiring lines 313 of a second wiring group from connecting terminals 010 through wiring lines 317 on both sides remaining divided.

Since the number of inner leads connected to the central wiring line 316 is three, the number of inner leads on both sides is required to be three or more in total. In this case, if the number of inner leads connected to the terminals on both sides is two on one side and one on the other side, a balance in wiring resistance is lost between left and right, and therefore printing element driving conditions should be optimized separately for the left and the right, which is absurd. For this reason, the number of inner leads connected to a terminal on each side is two obtained by rounding up 3/2=1.5 to keep the balance between left and right.

With this configuration, even in the case of larger current, wiring resistance within the printing element substrate and wiring resistance of the electrical wiring substrate can be minimized to improve efficiency. In the present embodiment as well, all the inner leads have the same width, and therefore single point bonding can be performed under the same conditions. In addition, the bonding can be performed in arrangement order of connecting terminals under the same conditions, and therefore a traveling distance of a tool can be minimized to shorten a bonding time.

Note that in the present embodiment, the number of central inner leads is an odd number; however, in the case of an even number, as in the second embodiment, it is only necessary that the number of inner leads on each side is (the number of central inner leads)/2.

Fourth Embodiment

A fourth embodiment of the present invention is described below with reference to drawings. Note that a basic configuration of the present embodiment is the same as that of the first embodiment, and therefore only a characteristic configuration is described below.

The present embodiment is optimally configured for the case where the number of wiring layers is one and multiple printing element arrays are provided.

Figure 5:
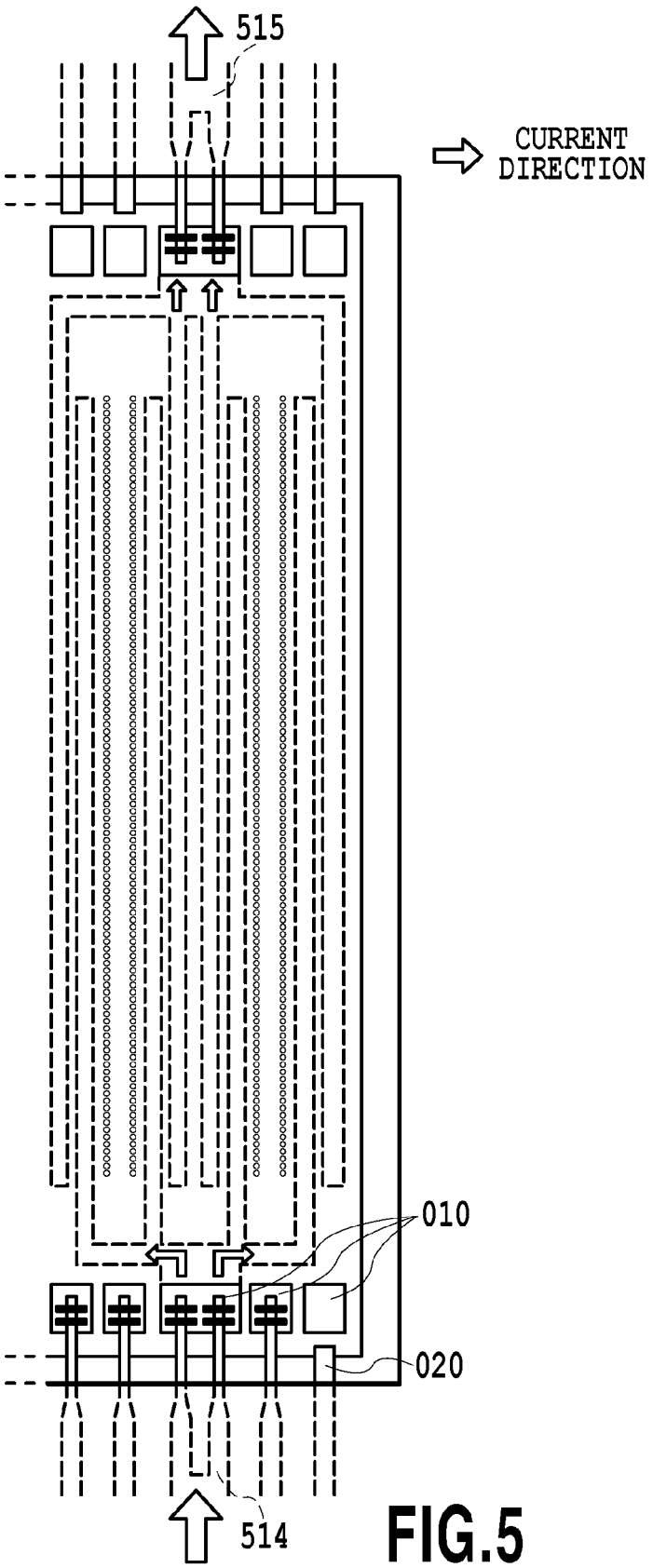
FIG. 5 is a view illustrating the connection between one of the printing element substrates and the electrical wiring substrate in FIG. 4A.

FIG. 5 is a view illustrating the connection between the printing element substrate B 305 and the electrical wiring substrate 003 in FIG. 4A. In the following, the connection with the printing element substrate B 305 is described using FIG. 5. The wiring layer having the multiple printing element arrays and applied with large current is configured as a single layer. A wiring line 514 of a second wiring group in the lower part of the view is connected to a connecting terminal 010 (at one end of the printing element substrate), and a connecting terminal (at the other end opposite to the one end of the printing element substrate) in the upper part of the view is connected to a wiring line 515 of the second wiring group via energy generating elements.

In the case where current flows out through the wiring line 515, a wiring distance on the electric wiring substrate is increased; however, the width of the printing element substrate is large, and the number of wiring lines having an inner lead is small. As a result, the width of the wiring line 514 on the electric wiring substrate can be made larger to reduce wiring resistance in total. In the present embodiment as well, all inner leads have the same width, and therefore single point bonding can be performed under the same conditions. In addition, the bonding can be performed in arrangement order of connecting terminals, and therefore a traveling distance of a tool can be minimized to shorten a bonding time.

As described above, even in any of the embodiments of the present invention, inner leads having the same width extend from wiring lines having different line widths, and consequently bonding can be performed under the same conditions to stably perform the bonding. In addition, the bonding can be performed in arrangement order of connecting terminals, and therefore a traveling distance of a tool can be minimized to shorten a bonding time. That is, the stability of bonding and the shortening of a bonding time can be both achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112725, filed May 30, 2014, and No. 2015-078012, filed Apr. 6, 2015, which are hereby incorporated by reference herein in their entirety.

What is claimed is:

1. A liquid ejection head comprising:

a printing element substrate that includes multiple connecting terminals; and an electric wiring substrate that includes a first wiring line having a first line width, a second wiring line having a second line width, and inner leads that separately connect the first wiring line to a connecting terminal and the second wiring line to a connecting terminal, wherein the first wiring line is provided with one of the inner leads, the second wiring line is provided with multiple inner leads, and the second line width is larger than the first line width.

2. The liquid ejection head according to claim 1, wherein the connecting terminals have multiple different sizes.

3. The liquid ejection head according to claim 1, wherein the inner lead provided for the first wiring line is connected to one of the connecting terminals, and the multiple inner leads provided for the second wiring line are connected to another one of the connecting terminals.

4. The liquid ejection head according to claim 1, wherein the printing element substrate has an energy generating element adapted to generate energy for ejecting liquid, and the second wiring line is connected to the energy generating element.

5. The liquid ejection head according to claim 4, wherein the printing element substrate includes an in-substrate wiring line that connects one of the connecting terminals and the energy generating element.

6. The liquid ejection head according to claim 5, wherein the printing element substrate includes a first in-substrate wiring line connected to the first wiring line, and a second in-substrate wiring line connected to the second wiring line.

7. The liquid ejection head according to claim 6, wherein a width of the second in-substrate wiring line is larger than a width of the first in-substrate wiring line.

8. The liquid ejection head according to claim 4, wherein two of the connecting terminals are provided in an end part on one side of the printing element substrate, the two connecting terminals corresponding to one energy generating element.

9. The liquid ejection head according to claim 5, wherein the in-substrate wiring line is disposed so as to include multiple layers in the printing element substrate.

10. The liquid ejection head according to claim 6, further comprising two first in-substrate wiring lines, wherein the second in-substrate wiring line is disposed in a central part of the printing element substrate, and the first in-substrate wiring lines are disposed on both sides of the printing element substrate across from the second in-substrate wiring line.

11. The liquid ejection head according to claim 1, wherein the second wiring line is provided with two of the inner leads.

12. The liquid ejection head according to claim 1, wherein the electrical wiring substrate includes a third wiring line having a third line width larger than the second line width.

13. The liquid ejection head according to claim 12, wherein the third wiring line is provided with three inner leads connecting the third wiring line and a connecting terminal to each other.

14. The liquid ejection head according to claim 1, wherein one of the two connecting terminals corresponding to one energy generating element is provided in an end part on one side of the printing element substrate, and the other of the two connecting terminals is provided in an end part opposite to the end part on the one side of the printing element substrate across from the energy generating element.

15. The liquid ejection head according to claim 1, wherein the second wiring line branches into multiple lines in an end part of the electric wiring substrate.

16. A liquid ejection head comprising:

a printing element substrate that includes first and second connecting terminals; and an electric wiring substrate that includes a first wiring line having a first line width, a second wiring line having a second line width larger than the first line width, a film member sandwiching the first wiring line and the second wiring line, and an opening part that is provided in the film member and for exposing the printing element substrate, wherein one end side of the first wiring line is exposed from an edge of the opening part of the film member as one wiring line, and connected to the first connecting terminal, and one end side of the second wiring line branches and is thereby exposed from the edge of the opening part of the film member as multiple wiring lines, and connected to the second terminal.

17. The liquid ejection head according to claim 16, wherein the second connecting terminal is larger than the first connecting terminal.

18. The liquid ejection head according to claim 16, wherein a branching part where the second wiring line branches is provided in an area sandwiched by the film member.

19. The liquid ejection head according to claim 16, wherein multiple first wiring lines are provided, and the second wiring line is provided between the multiple first wiring lines.

* * * * *